US005472396A

United States Patent [19]

Brazaitis

[11] Patent Number: 5,472,396

[45] Date of Patent: Dec. 5, 1995

[54] PORTABLE EXERCISE APPARATUS

[76] Inventor: David Brazaitis, 587 7th St., Norco, Calif. 91760

[21] Appl. No.: 91,198

[22] Filed: Jul. 14, 1993

[51] Int. Cl.[6] ..... A63B 69/16

[52] U.S. Cl. ..... 482/57; 482/60

[58] Field of Search ..... 482/57, 60, 904, 482/63, 64, 65, 119

[56] References Cited

U.S. PATENT DOCUMENTS

| | | | |
|---|---|---|---|
| 3,192,772 | 7/1965 | Tarter | 482/63 |
| 3,259,385 | 7/1966 | Boren | 482/63 |
| 3,910,571 | 10/1975 | Stenn | 482/60 |
| 4,390,177 | 6/1983 | Biran et al. | 482/60 |
| 4,577,860 | 3/1986 | Matias | 482/57 |

*Primary Examiner*—Stephen R. Crow

*Attorney, Agent, or Firm*—Chris Papageorge

[57] ABSTRACT

An exercise apparatus includes a frame having a front base member and a rear base member mounted at lower portions thereof. The apparatus also includes a pair of forks to which a wheel is rotatably mounted and a pedal drive mechanism for rotation of the wheel. The base members have flat bottom surfaces which are relatively long and wide in order to maximize frictional forces between the base members and the floor surface on which the apparatus is mounted. The apparatus is also provided with a pedal assembly which is positioned at a rearward location of the frame and situated relative to a user so that it enables the user who is seated on a chair proximal thereto to be in a desired position for effective pedalling of the apparatus. The apparatus is also provided with a belt looped around the wheel. A cable is secured to the belt. The cable sheath is anchored to the frame and connected to a lever which provides manual adjustment of the exercise load provided by the apparatus.

12 Claims, 5 Drawing Sheets

PORTABLE EXERCISE APPARATUS

BACKGROUND OF THE INVENTION

The invention relates generally to exercise apparatuses and, more particularly, to those which allow a-user to remain generally stationary while pedalling the device in order to achieve a desired degree of aerobic fitness.

Many types of exercise equipment and devices have been designed which allow a user to remain generally stationary while exercising. One of the most popular of such prior art devices enables a person to pedal his way to fitness while seated on the device. Although many people seem to enjoy bicycling as a form of exercise and the stationary type of such exercise devices have consequently enjoyed a great deal of popularity, such devices generally have the disadvantage of requiring a significant amount of space in the user's home and also tend to be somewhat heavy and difficult to move and reposition. In addition, the seats commonly employed on such devices generally tend to be hard and narrow resulting in a considerable amount of soreness and discomfort to the operator after extended periods of use. Moreover, many people find that the lack of a backrest on such devices results in back strain after prolonged periods of use. Consequently, these disadvantages have prevented such exercise devices from being more popularly used, and many exercise devotees have turned to other exercise systems or equipment.

In order to provide enhanced user comfort and obviate user back strain, some prior art bicycle type exercise apparatuses have been designed to allow a person to sit on a chair or other piece of furniture while exercise therewith. An example of such a prior art apparatus is disclosed in U.S. Pat. No. 4,928,673 to Heneger. The Heneger apparatus is essentially an electrically powered exerciser which enables a person seated on a wheelchair or other suitable piece of furniture to allow the exerciser to exercise the user's legs. Thus, the exerciser provides the user with passive exercise. Consequently, the user does not exert any pedalling forces directly on the device which would otherwise require the device to be made more sturdy and stable in order to accept these forces without undesired movement thereof. In addition, the Heneger device does not have a flywheel or other similar structure enabling the linear pedalling forces to be converted to rotational forces. Since rotational forces are generally more balanced than linear forces, the user's pedalling energy expended on such a device results in jerky pedalling movements as well as result in other such forces tending to move, tilt or otherwise upset the device. Consequently, such devices have the inherent disadvantage that they are impractical when utilized in an active exercising routine. In addition, such devices also require the use of an external power source which can make their use limited to locations which have access to an electrical power outlet. Consequently, although such devices are generally quite small and have a desired degree of compactness and portability, they must pragmatically be used in conjunction with other electrical equipment which detracts from their portability.

A bicycle type of exercise apparatus is thus needed which provides a desired degree of compactness and portability. Such an exercise apparatus is also needed which provides enhanced user comfort by allowing a person who is seated on a chair or lying on another suitable piece of furniture to exercise using the apparatus. Such an exercise apparatus is also needed which minimizes user back strain by allowing its use in conjunction with furniture which provides proper back support to the user.

SUMMARY OF THE INVENTION

It is a principal object of the present invention to provide an improved exercise apparatus allowing a user to exercise therewith while positioned on a suitable piece of furniture.

It is another object of the present invention to provide an exercise apparatus which may be used in conjunction with any desired suitable piece of furniture.

It is another object of the present invention to provide an exercise apparatus which has a desired degree of portability.

It is an object of the present invention to provide an exercise apparatus which may be placed in a variety of desirable suitable locations.

It is an object of the present invention to provide an exercise apparatus which has a relatively large base for enhanced stability during use.

It is an object of the present invention to provide an exercise apparatus which is relatively quiet during use.

It is also an object of the present invention to provide an exercise apparatus in which dimensions thereof may be selectively reduced to enhance compactness of the apparatus in order to facilitate storage thereof.

It is still another object of the present invention to provide an exercise apparatus for active exercising which is able to accommodate a moderate degree of exercise force exerted thereon by the user.

It is still another object of the present invention to provide an exercise apparatus which is relatively light-weight for manual portability.

The exercise apparatus of the present invention is specifically designed to allow a user who is seated on a piece of furniture such as a sofa chair to exercise his lower limbs by using the apparatus. Since the user can exercise with the exercise apparatus of the present invention while seated on a sofa chair selected for the comfort it provides, the user can be very comfortable while exercising since he may be using his favorite chair or other piece of furniture which provides him with the proper back and full buttock support as well as having a plush or soft seat bottom for enhanced comfort. In contrast, prior art bicycle type exercisers typically have a hard and narrow seat which may be very uncomfortable and produce soreness after prolonged use. Moreover, since the user can be seated or even lying down on a piece of furniture (or leaning against a wall or other suitable structure) which is deemed to fit the user very comfortably, this enables the user to exercise for a longer period of time due to enhanced user comfort than would be otherwise possible with other prior art exercise apparatus. This unique feature of the invention enables users who may have, for example, a back injury to nevertheless be able to exercise using the apparatus because they may be seated on a piece of furniture providing the proper back support. Moreover, a user may also exercise using the apparatus of the present invention while lying prone on a bed or other suitable piece of furniture. Consequently, an injured or disabled person who may be limited in his activities may nevertheless be able to utilize the apparatus of the present invention to exercise his or her lower limbs as well as to achieve a desired degree of cardiovascular or aerobic exercise as well. Moreover, although it may be inordinately costly to provide a very high quality seat on an exercise bicycle or similar device, a household piece of furniture may be well designed and utilize the proper, albeit expensive, materials required to provide a high-quality chair which the user may utilize while exercising with the apparatus of the present invention. Since such a high quality chair can serve the dual purpose of ordinary home use as well as exercise use, the user can receive the benefit of both having a relatively inexpensive exercise apparatus as well as simultaneously having a high-quality, comfortable and supportive chair to utilize while exercising therewith.

The exercise apparatus of the present invention includes a frame having a pair of base members at lower portions thereof. The base members preferably have flat bottom surfaces which maximize their contact area with the floor on which the frame is mounted in order to maximize the frictional forces between the floor and the base members to generally prevent the frame from sliding or otherwise moving on the floor in response to pedal forces exerted on the apparatus by the user. The exercise apparatus also includes a pair of forks between which the wheel is mounted by means of an axle which is rigidly secured to the forks at ends thereof. A suitable drive mechanism preferably comprising a chain and a pair of sprockets is also utilized. A pedal assembly is mounted on a rearward portion of the frame and operably connected to the wheel via the drive mechanism. The pedal assembly is preferably mounted at a rear upper corner of the frame so that it is proximal to the user. The pedal assembly is also preferably located so that it is spaced a desired height from the floor (or the base members' bottom surfaces) and a desired distance from the rear base member so that it is positioned at a desired distance from the user's pelvis and at a desired angle with respect to the user's pelvis to facilitate pedalling of the apparatus. This positioning of the pedal assembly allows the user to be properly situated relative to the apparatus so that the user's calves do not hit the chair and the user's knees are bent at the proper angle while using the apparatus. This enhances ease of use as well as exercise effectiveness in exercising using the apparatus.

The frame is mounted on a floor surface by simply placing the frame at a suitable location thereof and thus does not require any bolts or other clamping or other attachment means thereto. Since it is generally not secured to the floor surface, it may be manually positioned and repositioned thereon. However, the base members have flat bottom surfaces providing maximal frictional forces between the floor and the frame which generally prevent undesired movement of the frame on the floor. Since the frame is not clamped or otherwise securely attached to the floor, it may be moved to any desired location on the floor and additionally may be simply picked up and removed from the floor surface when further utilization thereof is not desired or to free up floor space. Thus, the apparatus may be simply manually picked up and placed into a closet or other out-of-the-way area when not in use without taking up space that may be used for other purposes. In addition, this also allows the user to desirably place the apparatus in any room in the house in which the person desires to exercise, thereby enabling the person to exercise while watching TV, listening to music, etc. Moreover, the apparatus may also be moved outdoors onto a porch, lawn or wherever a suitable chair or other suitable furniture may be available for use therewith. Since the apparatus does not require a very stable surface because the user is not seated on the apparatus and, therefore, need not worry about falling off the apparatus and sustain accidental injury that might otherwise ensue if the user were seated a prior art exerciser positioned on a lawn or other ground or floor surface which might not provide a sufficiently level or stable foundation for such prior art exercisers.

The apparatus of the present invention does not have a seat or set of handlebars mounted thereon. This enhances the lightweight and compactness of the exercise apparatus and provides it with a desired degree of portability.

DETAILED DESCRIPTION OF THE PREFERRED EMBODIMENT

Figure 1:
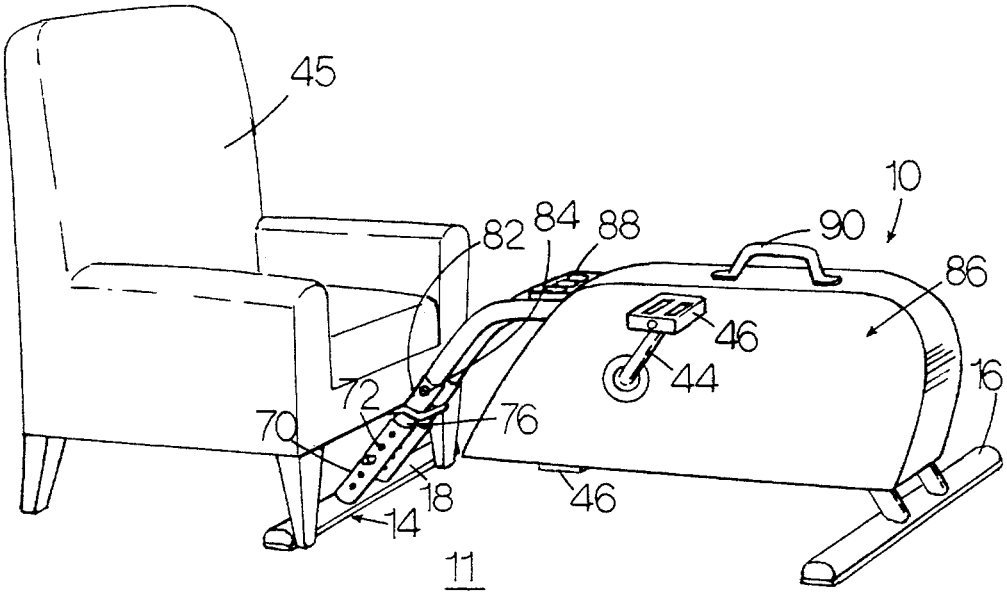
FIG. 1 is a side view of a first embodiment of the apparatus of the present invention showing the cover of the apparatus mounted on the frame and the apparatus positioned adjacent a chair.
Figure 2:
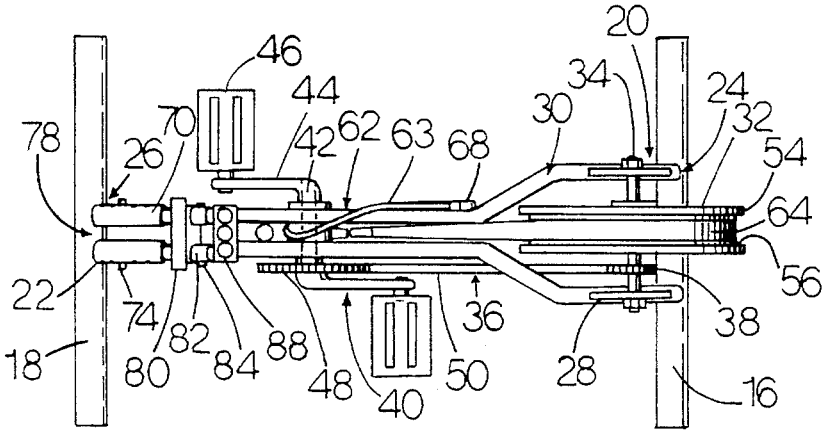
FIG. 2 is a top plan view of the embodiment of FIG. 1 without the cover mounted on the frame of the apparatus.
Figure 3:
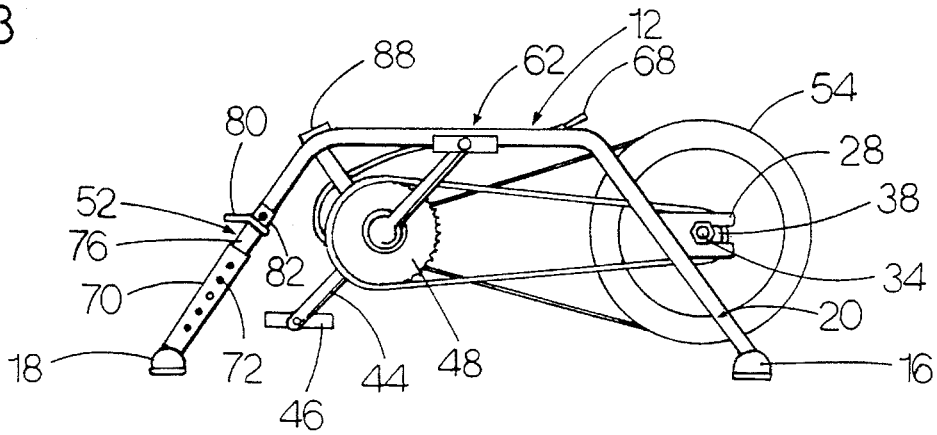
FIG. 3 is a side elevational view of the first embodiment of FIGS. 1 and 2 with the cover removed from the frame thereof in order to show other components thereof.
Figure 4:
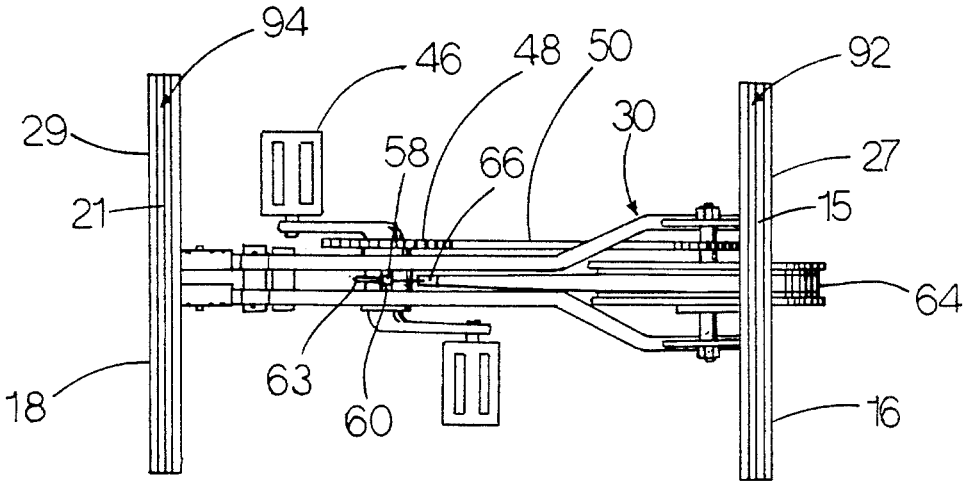
FIG. 4 is a bottom plan view of the embodiment of FIGS. 1, 2 and 3 showing the bottom flat surfaces of the base members of the frame.
Figure 5:
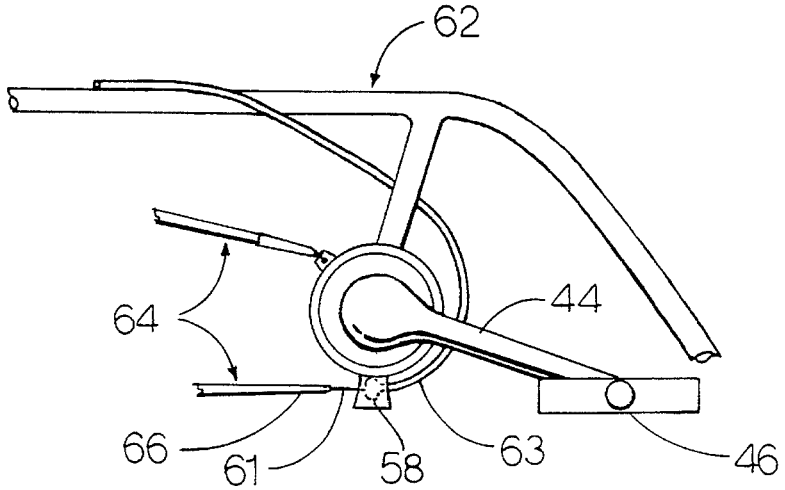
FIG. 5 is a side elevational view of a portion of the embodiment of FIGS. 1, 2, 3 and 4 showing the cable and related structures for adjusting the load on the wheel of the apparatus.

Referring now to the drawings, FIGS. 1, 2, 3, 4 and 5 show a first embodiment of the present invention generally designated by the numeral 10. The apparatus 10 is specifically designed to be used in conjunction with a chair or other suitable piece of furniture external to the apparatus 10 and unsecured thereto. Apparatus 10 preferably includes a frame 12 which has a base 14 which preferably comprises front base member 16 and rear base member 18 located at lower longitudinal ends of the frame 12. The front base member 16 is preferably connected to the frame 12 at its front end portion 20 thereof. Similarly, the rear base member 18 is preferably connected to the frame 12 preferably at its rear end portion 22 thereof. In addition, the front base member 16 is preferably connected to the front end portion 20 at approximately medial portions 24 of the base member. Similarly, the rear base member 18 is preferably connected to the rear end portions 22 of the frame 12 at medial portions 26 of the rear base member 18. These medial portion connection points equalize the lateral stability provided in each lateral direction by the frame 12.

The front base member 16 is provided with front grip pads 27 mounted at the bottom surfaces 15 thereof. Similarly, the rear base member 18 is provided with rear grip pads 29 mounted at the bottom surfaces 21 thereof. The entire bottom surfaces 15 and 21 are preferably generally flat and preferably extend generally the entire lateral width of the base 14 in order to maximize the surface area in contact with the floor surface 11 and thereby maximize frictional forces therebetween. The grip pads 27 and 29 have a generally ribbed surfaces 92 and 94 in order to increase the frictional forces resisting movement of the frame 12 along the floor surface 11 on which it is mounted.

The frame 12 is preferably also provided with a pair of forks 28 at a generally forward portion 30 of the frame 12. A wheel 32 is also rotatably mounted on the frame 12. The wheel 32 preferably includes an axle 34 which is rigidly connected to the pair of forks 28 so the wheel can rotate relative to the frame 12. The axle 34 is preferably positioned generally rearward of the front base member 16 in order to enhance longitudinal stability of the apparatus 10.

A drive mechanism 36 is preferably also provided for operation of the wheel 32. The drive mechanism 36 preferably includes a drive sprocket 48, a driven sprocket 38 and a chain 50 interconnecting the sprockets 38 and 48. the driven sprocket 38 is rigidly connected to the wheel 32 and rotatably connected to the axle 34.

The apparatus 10 also includes a pedal assembly 40. Pedal assembly 40 preferably includes a crankshaft 42 rotatably mounted in the frame 12 preferably at a generally rearward portion 52 thereof. The crankshaft 42 is preferably positioned forward of the rear base member 18 to enhance the longitudinal stability of the apparatus 10. The pedal assembly preferably includes a pair of cranks 44 preferably rigidly connected to the crankshaft 42 at inner ends thereof. The cranks are preferably approximately six inches in length. In addition, a pair of pedals is provided and rotatably connected to the pair of cranks at outer ends thereof. The drive sprocket 48 is also preferably rigidly secured to the crankshaft 42. The chain 50, which is preferably an endless chain 50, preferably interconnects drive sprocket 48 and driven sprocket 38 in order to allow a user who is using the apparatus 10 to rotate the wheel 32 by means of the pedal assembly 40.

The wheel 32 is preferably provided with a wheel rim 54 which is preferably provided with a groove 56 around the entire circumference thereof. A belt 64 is looped around the wheel 32 so that it fits within the groove 56 of the wheel 32. The belt 64 is secured at an end 66 thereof to a cable 61. A cable sheath 63 is secured to a cable anchor 58. The anchor 58 is secured to a bracket 60 which is securely mounted on the frame 12. The cable 61 is connected to a lever 68 which is mounted on the frame 12. Manual movement of the lever 68 moves the belt end 66 longitudinally toward or away from the wheel 32 resulting in tightening or loosening of the belt around the wheel 32. Adjusting the tension of the belt 64 increases the frictional forces on the wheel 32, thereby placing a load on+ the rotation of the wheel 32 in order to adjust the degree of exercise resistance afforded to the user.

The rear portion 52 of the frame 12 is preferably provided with a sleeve 70 which is preferably a pair of sleeves 70 into which leg portions 76 of the frame are inserted. Thus, the leg portions 76 are preferably slidably movable within the sleeve 70. The sleeves 70 are preferably provided with a set of apertures 72 into which a pair of pins 74 are inserted in order to lock the leg portions 76 within the sleeve 70 and prevent relative movement therebetween. The sleeves 70, apertures 72, pins 74 and leg portions 76 preferably comprise an adjustment means 78 which allows selective adjustment of the height of the frame 12 and, more specifically, the rear portion 52 of the frame 12. Essentially, the adjustment means 78 allows the pedal assembly 40 to be adjusted in height in order to accommodate the height of the chair or other piece of furniture with which the apparatus 10 is to be used as well as also accommodating the particular height of the user. When adjusted to its lowest level, the rear portion 52 positions the crankshaft 42 axis approximately nine and one-half inches from the floor surface 11. The range of adjustment afforded by the adjustment means 78 is preferably approximately four inches.

The rear portion 52 of the frame 12 is preferably also inclined at an approximately 60 degree angle such that the rear portion 52 extends generally upwardly and forwardly from the rear base member 18. This angling of the rear portion 52 generally places the weight of the apparatus 10 at the rear portion 52 generally underneath the chair on which the user is seated thereby enhancing the stability of the apparatus. In addition, the angling of the rear portion 52 also allows the frame 12 and, more specifically, the rear portion 52 to be generally wedged underneath a chair with which the apparatus is to be used in order to generally provide more stability to the apparatus and allow it to accept the forces of use without undesired movement thereof.

A stop 80 is preferably movably attached to the rear portion 52 of the frame 12. The stop 80 is preferably provided with a stop collar 82 which fits around the leg portions 76 and allows the stop 80 to be moved generally up and down on the leg portions. A set screw 84 is preferably provided in each of the stop collars 82 in order to lock the stop in a desired position. When the apparatus 10 is used in conjunction with a suitable chair, the stop 80 is positioned underneath and in contact with a lower portion of the chair in which the user is seated while exercising. The stop 80 results in the weight of the chair and user seated thereon to generally press down on the apparatus 10 generally preventing movement thereof and thereby enhancing its stability while in use. In addition, positioning the stop 80 in contact with the lower portion of the chair more effectively wedges the rear portion 52 of the frame 12 under the chair. Thus, this enables the stop 80 to prevent upward movement of the apparatus while in use and generally also tends to stabilize and minimize generally horizontal movement of the apparatus 10 resulting from pedal forces exerted by the user.

The apparatus 10 is preferably also provided with a cover 86 which generally covers the frame medial portion 62 and forward portion 30 while leaving generally the rear portion 52 of the frame 12 uncovered. In addition, the crankshaft 42 ends extend out of the cover 86, and the pair of cranks 42 and the pair of pedals 46 preferably also are positioned outside of the cover 86. However, the wheel 32 and the drive mechanism 36 preferably are contained within the cover 86. This effectively allows the moving parts of the apparatus 10 to be generally contained therein and muffles the noise generated thereby. Thus, the cover 86 makes the apparatus 10 generally more quiet thereby minimizing disturbance to other persons and enabling the user to engage in other recreational activities such as listening to music, watching television, etc. The cover 86 also generally prevents the user's pants or other clothing or body parts from getting caught in the drive mechanism 36 and thus provides a degree of safety to the apparatus 10. The cover 86 is preferably provided with a handle 90 in order to facilitate carrying the apparatus 10 to and from desired locations. An instrument panel 88 is preferably provided and mounted generally on the rear portion 52 of the frame 12. The instrument panel 88 is preferably connected to the crankshaft 42 via sensors and wires (not shown) in order to provide a readout of the rpms of the crankshaft 42 and in order to yield a readout of the amount of exercise provided by the apparatus.

Figure 6:
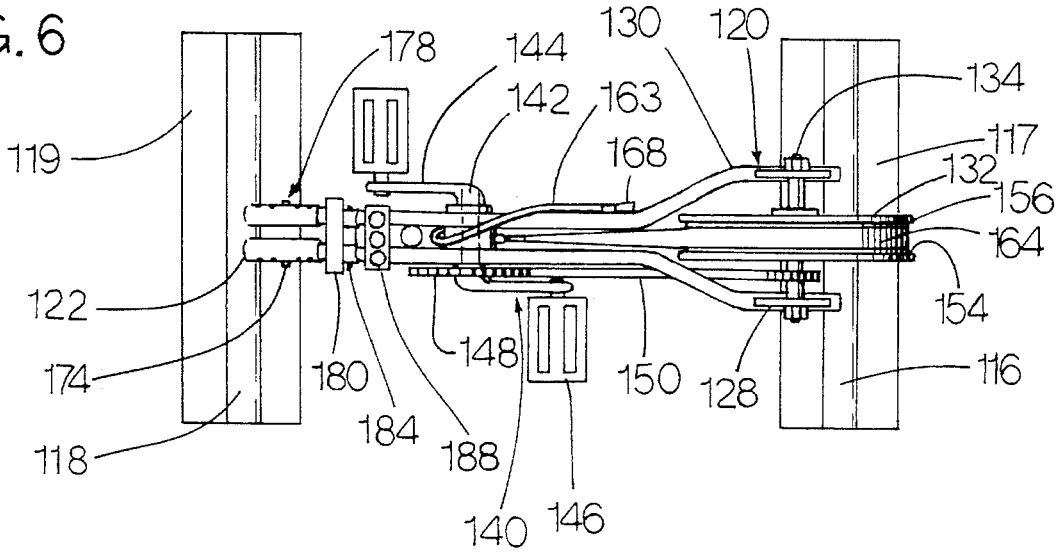
FIG. 6 is a top view of a second embodiment of the apparatus of the present invention without the cover mounted on the frame.
Figure 7:
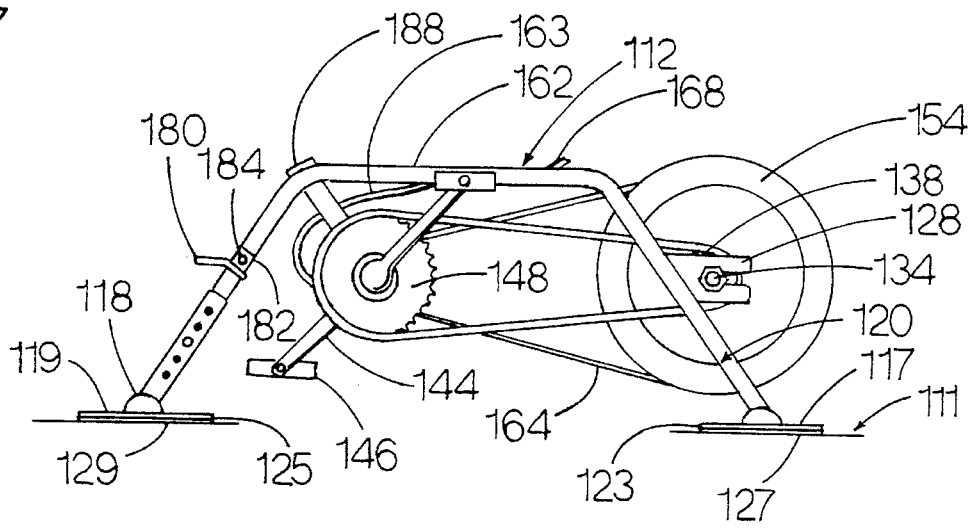
FIG. 7 is a side elevational view of the embodiment of FIGS. 5 and 6.
Figure 8:
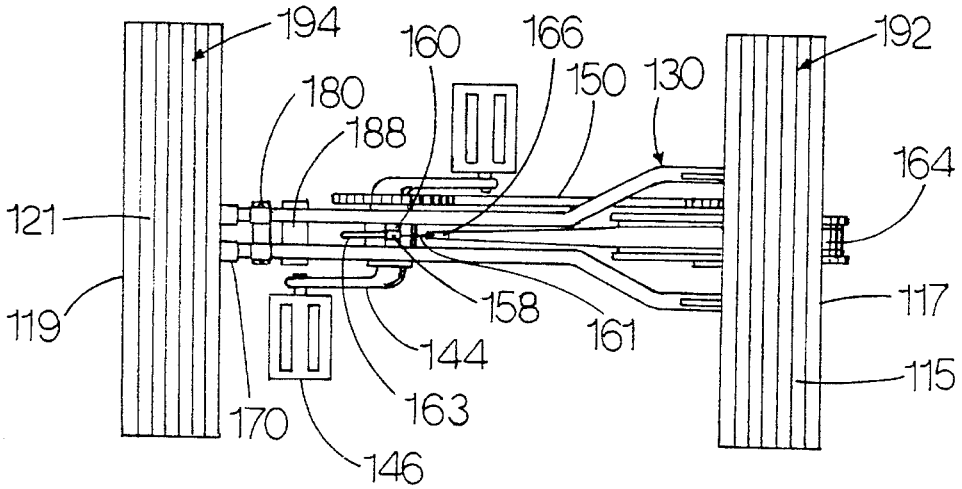
FIG. 8 is a bottom plan view of the embodiment of FIGS. 5, 6 and 7.
Figure 9:
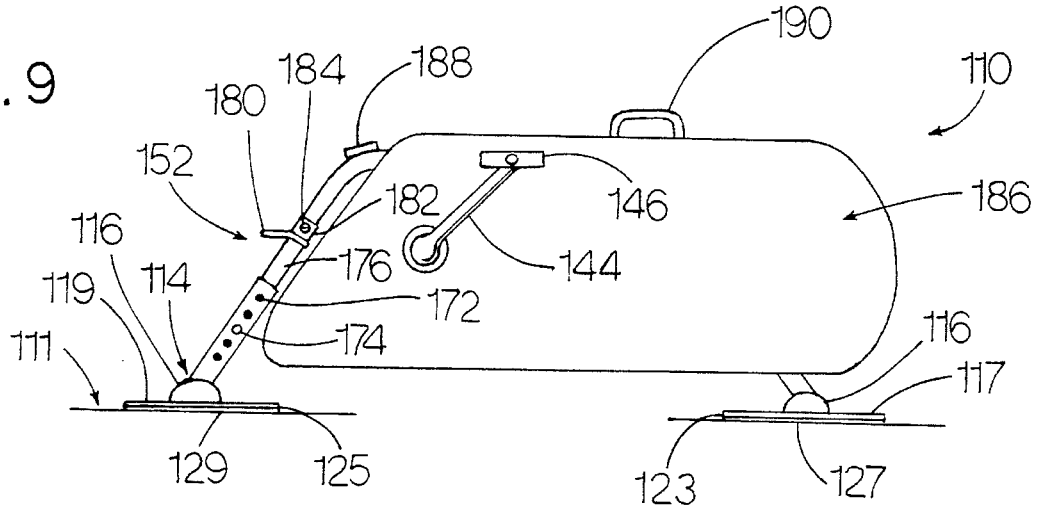
FIG. 9 is a side elevational view of the embodiment of FIGS. 5, 6, 7 and 8 also showing the cover mounted on the frame and showing the base members thereof.

FIGS. 6, 7, 8 and 9 show a second embodiment 110 of the invention. Embodiment 110 includes a frame 112, a base 114 connected at front end portions 20 and rear end portions 22 of the frame 12. The base 114 preferably includes a front base member 116 and a rear base member 118 connected at a medial portion 124 of the front base member and at a medial portion 126 of the rear base member 118 to the frame 112 at front end portions 20 and rear end portions respectively thereof.

Second embodiment 110 is generally similar to embodiment 10 except that front base member 116 has a front planar member 117 securely attached thereto at the bottom surface 115 thereof. Similarly, embodiment 110 has a rear planar member 119 secured to the rear base member 118 at the bottom surface 121 thereof. The width of the planar members 117 and 119 is large relative to the width of the base members 116 and 118 in order to increase the frictional forces provided by the bottom surfaces 123 and 125 of the planar members. This generally increases the resistance of the apparatus to movement along the floor surface 111 during use thereof when subjected to the oftentimes moderate degree of pedal forces to which the apparatus 10 is subjected. In addition, the wheel rim 154 is preferably composed of a metal or otherwise weighted in order to provide sufficient inertia to the wheel during rotation thereof to generally convert the generally linear forces exerted by the user's legs when pedalling the apparatus 110 into generally rotational or centrifugal forces. This also enables the apparatus 110 to resist movement thereof along the floor surface 111 during use thereof.

As with embodiment 10, embodiment 110 is preferably also provided with a front grip pad 127 mounted on the bottom surface 123 of the front planar member 117 and a rear grip pad 129 securely mounted on the bottom surface 125 of the rear planar member 119 in order to enhance the frictional forces between the planar members 117 and 119 and the floor surface 111. The grip pads 127 and 129 preferably have ribbed bottom surfaces 192 and 194 to enhance frictional forces between the grip pads 127 and 129 and the floor surface 111. These grip pads 127 and 129 also increase the stability of the apparatus 110 by enabling it to resist movement thereof on the floor surface 111 during use.

Embodiment 110 also includes a pair of forks 128 at the forward portion 130 of the frame 112 and a wheel 132 rotatably mounted on the pair of forks 128 by means of an axle 134 rigidly secured thereto. A drive mechanism 136 is preferably provided to enable user rotation of the wheel 132, and a pedal assembly 140 is preferably also provided in order to drive the drive mechanism 136 and rotate the wheel 132 to provide a desired degree of exercise to the user. As with embodiment 10, the front base member 116 is positioned forward of the axle 134, and the rear base member 118 is positioned rearward of the crankshaft 142 for enhanced longitudinal stability of the apparatus 10.

Embodiment 110 also includes a driven sprocket 138, a crankshaft 142, a pair of cranks 144, a pair of pedals 146, a drive sprocket 148 and a preferably endless chain 150. The frame 112 also includes a rear portion 152. The wheel 132 also is provided with a wheel rim 154 which has a groove 156 at the circumference thereof. Embodiment 110 includes an anchor 158 to which cable sheath 163 is attached and a bracket 160 mounted at the medial portion 162 of the frame 112. The belt 164 is slidably mounted in the groove 156 of the wheel rim 154 and secured at an end 166 thereof to the cable 161. A lever 168 provides manual tension adjustment of the belt 164. A pair of sleeves 170 are provided which receive leg portions 176 therein and allow sliding movement of leg portions 176 therein. The pair of sleeves 170 preferably include apertures 172 which receive pins 174 in order to lock the leg portions 176 in the desired position in the sleeves 170. The adjustment means 178, which comprises sleeves 170, apertures 172 and pins 174, allows adjustment of the height of the rear portion 152 of the frame 112. Embodiment 110 also includes a stop 180, a stop collar 182, stop set screws 184, a cover 186 and instrument panel 188 connected to sensors (not shown) via wires (not shown). In all respects other than as described hereinabove, embodiment 110 is structurally and functionally identical to embodiment 10, so its further description will not be repeated in order to promote brevity.

Figure 10:
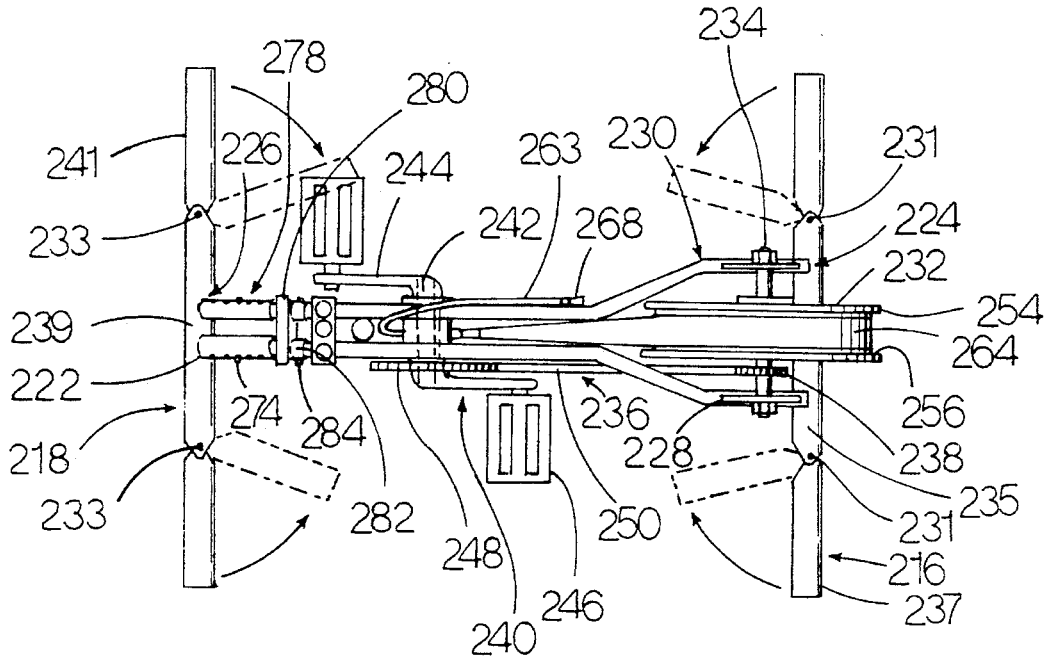
FIG. 10 is a top view of a third embodiment of the exercise apparatus of the present invention without the cover mounted on the frame.
Figure 11:
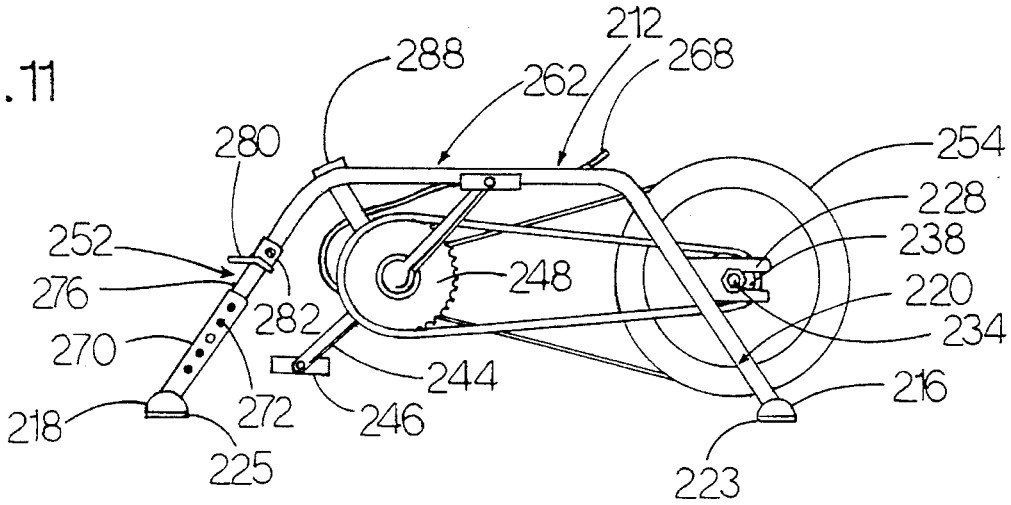
FIG. 11 is a side elevational view of the embodiment of FIG. 10.
Figure 12:
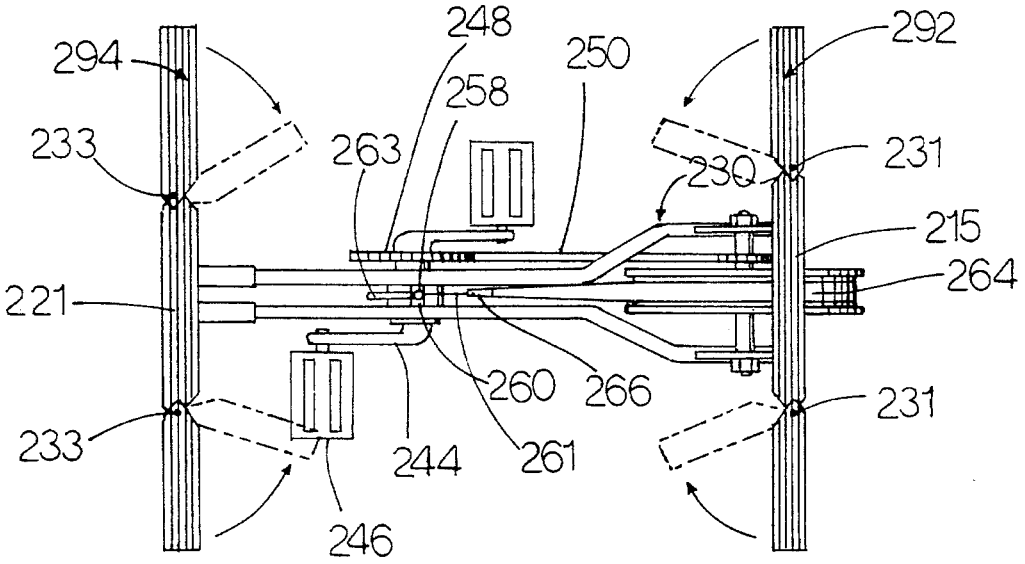
FIG. 12 is a bottom view of the embodiment of FIGS. 10 and 11 showing the bottom surfaces of the folding base members.
Figure 13:
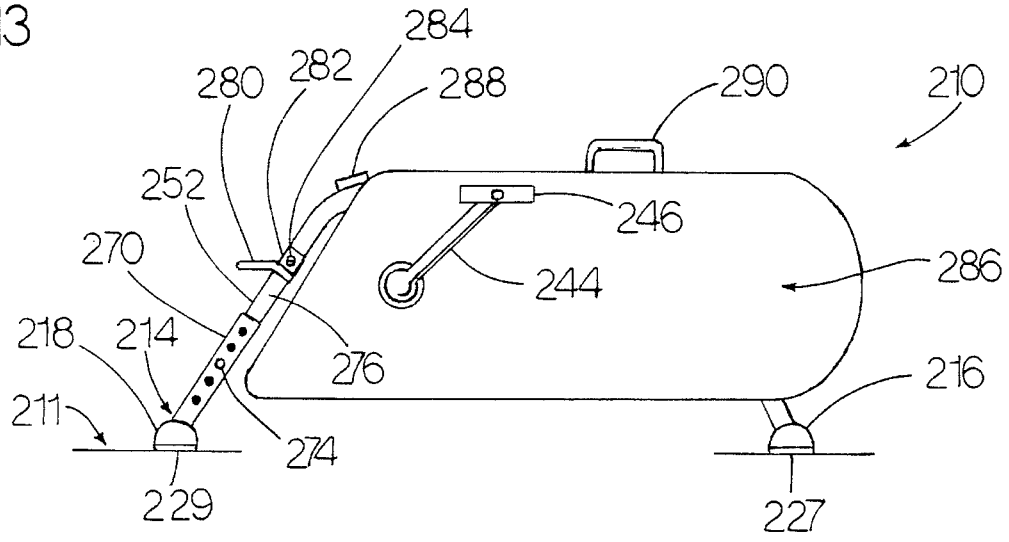
FIG. 13 is a side elevational view of the embodiment of FIGS. 10, 11 and 12 also showing the cover mounted on the frame.

FIGS. 10, 11, 12 and 13 show a third embodiment 210 of the invention. As with embodiments 10 and 110, embodiment 210 is designed specifically to be removably mounted on a floor surface 211 and is, therefore, not secured thereto but rather simply placed thereon. Embodiment 210 preferably includes a frame 212 having a base 214 with front base member 216 having a front bottom surface 223 and a rear base member 218 having a rear bottom surface 225. Embodiment 210 is generally similar to embodiments 10 and 110 except that its front base member 216 includes a pair of front inner base members 235 and a pair of front outer base members 237. Inner and outer base members 235 and 237 are preferably interconnected by a pair of hinges 231. The pair of hinges 231 preferably allow the inner base members 235 to rotate in a generally horizontal plane relative to the outer base members 237 so that the front base member 216 can fold from a generally laterally extended position into a generally forwardly folded position. This enables the front base member 216 when in an extended position to have larger lateral dimensions and thereby to have more stability, whereas when in the folded position, it has smaller lateral dimensions allowing it to be more compact for storage. The rear base member 218 preferably similarly includes a pair of rear inner base members 239 and a pair of rear outer base members 241. The inner and outer base members 239 and 241 are preferably interconnected by a pair of hinges 233 which allow relative rotation of the inner and outer base members 239 and 241 in a generally horizontal plane. These structures enable the rear base member 218 to fold from a generally laterally extended position to a generally laterally folded position as with front base member 216.

The front and rear base members 216 and 218 are preferably connected to the frame 212 at a medial portion 224 of the front base member and at a medial portion 226 of the rear base member. The bottom surfaces 223 and 225 of the base members 216 and 218 are preferably also flat, as with embodiments 10 and 110, in order to maximize the bottom surface area in contact with the floor surface 211 to increase frictional forces therebetween and generally enable the apparatus 210 to resist undesired movement during use, as with embodiments 10 and 110. Front grip pads 227 are preferably mounted on the bottom surfaces 223 of the front base member 216, and rear grip pads 229 are preferably mounted on the bottom surfaces 225 of the rear base member 218. Grip pads 227 and 229 preferably have ribbed bottom surfaces 292 and 294, as with pads 27 and 29 of embodiment 10 and pads 127 and 129 of embodiment 110.

Embodiment 210 also includes a pair of forks 228 at the forward portion 230 of the frame 212. A wheel 232 is rotatably mounted on the frame 12 by means of a wheel axle 234 rigidly connected to the forks 228. Embodiment 210 also includes a drive mechanism 236, a driven sprocket 238, a pedal assembly 240, a crankshaft 242, a pair of cranks 244 and a pair of pedals 246 connected to said pair of cranks 244. In addition, embodiment 210 also includes a drive sprocket 248 and a preferably endless chain 250 for rotation of the wheel 232. As with embodiments 10 and 110, the pedal assembly 240 is preferably connected to the frame 212 at the rear portion 252 thereof. In addition, wheel 232 has a wheel rim 254 having a groove 256 at the circumference thereof and an anchor 258 to which a cable sheath 263 is secured. The anchor 258 is also secured to a bracket 260 which is secured to the frame 210 at the medial portion 262 thereof. A belt 264 is secured to a cable 261 and slidably mounted on the wheel 232 so that it fits within the groove 256 thereof. A lever 268 is provided which is mounted on the frame 212 and connected to the cable 261 in order to generally adjust the belt tension and increase or decrease the frictional forces on the wheel 232 to generally adjust the load applied to rotation of the wheel 232. In addition, embodiment 210 is also provided with a pair of sleeves 270 at the rear portion 252 of the frame. The sleeves 270 preferably are generally tubular and receive leg portions 276 therein. Leg portions 276 thus are slidably movable in sleeves 270. Sleeves 270 preferably also include apertures 272 which receive pins 274 in order to generally adjust the height of the rear portion 252. The adjustment means 278, which comprises sleeves 270, apertures 272 and pins 274, is also provided to primarily generally adjust the height of the pedal assembly 240 in order to accommodate the height of the chair or other furniture with which the apparatus 210 is to be used or to accommodate the height of the user.

Embodiment 210 also includes a stop 280 having a pair of stop collars 282 which fit around the leg portions 276 and a pair of stop set screws 284 in order to adjust the height of the stop 280. Embodiment 210 also includes a cover 286 and an instrument panel 288 connected to sensors (not shown) via wires (not shown). In all respects other than as noted hereinabove, embodiment 210 is structurally and functionally identical to embodiments 10 and 110, so their further descriptions will not be repeated in order to promote brevity.

Accordingly, there has been provided, in accordance with the invention, a portable stationary exercise apparatus which may be used by a person who is seated or otherwise positioned on a piece of furniture external to the apparatus. It is to be understood that all the terms used herein are descriptive rather than limiting. Although the invention has been described in conjunction with the specific embodiments set forth above, many alternative embodiments, modifications and variations will be apparent to those skilled in the art in light of the disclosure set forth herein. Accordingly, it is intended to include such alternative embodiments, modifications and variations that fall within the spirit and scope of the invention as set forth in the claims hereinbelow.

I claim:

1. A portable, stationary exercise apparatus, comprising:

a frame removably mounted on a floor surface, said frame dimensioned to enable a user to use the apparatus while positioned on or against a structure external to the apparatus;

a wheel rotatably mounted on said frame, said wheel having an axle rigidly attached to said frame;

a drive mechanism operatively connected to said wheel;

a pedal assembly operatively connected to said drive mechanism;

a stop, said stop having a stop collar, movably mounted on said frame and a stop set screw connected to said stop collar for engagement with said frame in order to retain said stop collar in a desired position on said frame, said stop positioned for engagement with furniture on which a user of the apparatus is seated or lying so that weight of the user and the furniture rests on the stop and said frame in order to minimize undesired movement of the apparatus while in use.

2. The apparatus of claim 1 wherein said frame includes a base having a generally flat bottom surface so that frictional forces between said bottom surface and the floor resist movement of the apparatus relative to the floor and along the floor during use of the apparatus.

3. The apparatus of claim 2 wherein generally the entire bottom surface is flat and generally in contact with the floor surface during use of the apparatus in order to maximize frictional forces resulting therefrom, said bottom surface extending generally entire width of said base.

4. The apparatus of claim 2 wherein said base includes a pair of base members at each lower longitudinal end of said frame.

5. The apparatus of claim 2 further including a planar member mounted at a lower portion of said base member at the bottom surface thereof and extending generally entire lateral width thereof and having a large longitudinal length relative to longitudinal length of the base for enhancing frictional forces between said planar member and the floor surface.

6. The apparatus of claim 1 wherein said frame has a rear base member which is angled and dimensioned so that it can be generally wedged underneath a chair in order to generally prevent upward movement of the apparatus and movement of the apparatus along the floor surface during use, said stop mounted on an angled portion of said rear base member for retaining said frame in a desired wedged position underneath the chair.

7. The apparatus of claim 1 further including a means for applying a selected degree of resistance to said wheel to resist rotation thereof in order to apply a selected exercise load to operation of said drive mechanism.

8. The apparatus of claim 7 wherein said means for applying includes:

a belt slidably mounted around outer rim of said wheel;

a cable secured to said belt, said cable having a cable sheath;

an anchor, said cable sheath secured to said anchor;

a bracket secured to said anchor, said bracket securely mounted on said frame;

a lever connected to said cable for manually moving an end of said cable relative to said wheel in order to adjust tension on said belt for adjusting resistance to rotation of said wheel.

9. The apparatus of claim 4 wherein said front base member is positioned generally forward of said axle in order to generally prevent movement of said frame relative to the floor surface and along said floor surface during use of the apparatus.

10. The apparatus of claim 1 wherein said drive mechanism includes:

a driven sprocket operatively connected to said wheel for rotation thereof;

a drive sprocket;

an endless chain interconnecting said sprockets.

11. The apparatus of claim 10 wherein said pedal assembly includes:

a crankshaft rotatably mounted on said frame at a rear portion thereof and rigidly connected to said drive sprocket for rotation thereof;

a pair of cranks rigidly connected to said crankshaft at ends thereof;

a pair of pedals rotatably mounted on said pair of cranks.

12. A portable, stationary exercise apparatus, comprising:

a frame removably mounted on a floor surface, said frame dimensioned to enable a user to use the apparatus while positioned on or against a structure external to the apparatus, said frame having a pair of forks located at a front portion of said frame, said frame having a front base member and a rear base member, said base members having generally flat bottom surfaces extending generally entire lateral and longitudinal dimensions of said base members, said front base member including a pair of front outer base members and a pair of front inner base members, said rear base member including a pair of rear outer base members and a pair of rear inner base members;

a front hinge interconnecting said pairs of fribt outer and inner base members to allow rotation of said front base members from an extended position to a folded position;

a rear hinge interconnecting said pairs of rear outer and inner base members to allow rotation of said pairs of rear base members from an extended position to a folded position for maximizing lateral dimensions of said pairs of base members when in an extended position for enhanced stability of the apparatus and for minimizing lateral dimensions of said base members when in a folded position to enhance compactness thereof for storage of the apparatus;

a front set of grip pads firmly attached to said bottom surfaces of said front base members;

a rear set of grip pads firmly attached to said bottom surfaces of said rear base members, said front and rear sets of grip pads having ribbed bottom surfaces for generally enhancing frictional forces between said base members and the floor surface in order to generally resist movement of the apparatus relative to the floor surface and along the floor surface, said front and rear sets of grip pads covering the entire bottom surfaces of said base members;

a wheel having an axle rigidly mounted on said forks so that said wheel is rotatable relative to said frame;

a drive mechanism mounted on said frame and operatively connected to said wheel;

a pedal assembly operatively connected to said drive mechanism.

* * * * *